United States Patent [19]

Oka

[11] 4,253,004

[45] Feb. 24, 1981

[54] MECHANICAL REMOTE CONTROL SYSTEM

[75] Inventor: Shunzo Oka, Hirakata, Japan

[73] Assignee: Matsushita Electric Industrial Co., Ltd., Osaka, Japan

[21] Appl. No.: 78,898

[22] Filed: Sep. 25, 1979

[51] Int. Cl.[3] ..... H01H 3/20

[52] U.S. Cl. ..... 200/331; 200/336; 74/10 A

[58] Field of Search ..... 200/331, 336; 64/1 S; 74/10 A

[56] References Cited

U.S. PATENT DOCUMENTS

| | | | |
|---|---|---|---|
| 519,354 | 5/1894 | Sheppard | 200/331 |
| 3,193,653 | 7/1965 | Cope | 200/336 |
| 3,621,158 | 11/1971 | Swinstead | 200/336 |

*Primary Examiner*—Willis Little

*Attorney, Agent, or Firm*—Burgess, Ryan and Wayne

[57] ABSTRACT

A mechanical control system comprising a master or a controller which is rotated in control operations, a slave or a controlled unit such as a rotary electric control component such as a variable resistor, and a mechanical power transmission means for interconnecting between the master and slave for transmitting the turning force of the master to the slave. The mechanical power transmission means comprises a core and a plurality of helical spring layers tightly wound one upon another alternately in the opposite directions so that the angular mismatching or misalignment between the master and slave may be avoided. Since the master and slave may be spaced apart from each other, the layouts of electric components may be remarkably facilitated even in a very limited space.

12 Claims, 5 Drawing Figures

MECHANICAL REMOTE CONTROL SYSTEM

BACKGROUND OF THE INVENTION

The present invention relates to a mechanical remote control system wherein the control manipulation or rotation by a master or controller may be transmitted through a power transmission means to a slave or controlled unit which in turn changes for instance its electrical quantity as in the case of a variable resistor or its electrical stage as in the case of a rotary switch in response to the angle of rotation transmitted from the master.

In the conventional rotary electrical components such as variable resistors, rotary switches and so on, the rotation control or operating means is formed integral with a rotary part which causes the change in electric quantity such as resistance or state such as on-off of the electrical component. As a result, once the position of the operating means such as a knob of a variable resistor on a front panel of for instance an audio equipment is determined, the variable resistor must be located just behind of the front panel in line with the knob. Therefore various printed circuit boards must be prepared depending upon the arrangements of electric control components or more specifically of their operating means. In addition, because of the electric relationships between the electric control components and electrical components on the printed circuit board, additional wiring of shield wires is needed especially in the audio equipment. Furthermore, the shafts and bushings of various sizes of operating means must be fabricated depending upon the designs of electric equipment, and from the standpoint of standardization of electric components or any other parts it is not preferable to prepare and stock such components which widely varies in size.

Meanwhile, there has been proposed a system in which an operating means, for instance a knob, is separated from an electric control means such as a variable resistor and they are drivingly interconnected with a rotating force transmission means for transmitting the rotation of the operating means such as a knob to the electric control means such as a variable resistor. However, because of the designs and construction of the power transmission means, the control is not satisfactorily reliable in practice. For instance, there occurs the so-called "angular mismatching or misalignment" problem that the electric control means cannot correctly follow the rotation of the operating means. For instance even when the operating means is rotated through 30°, the electric control means is rotated only through 29°. As a result, even though the operating means is rotated to a predetermined angular position in every control operation, the response such as the change in resistance or on-off state of the electric control means changes from one operation to another.

SUMMARY OF THE INVENTION

In view of the above, the primary object of the present invention is to provide a mechanical remote control system wherein the rotation in either direction of a controller such as a knob may be positively and accurately transmitted through a mechanical power transmission means to a controlled unit such as a rotary electric control component such as a variable resistor which is remotely positioned so that a rotating part of the electric control component may correctly follow the angle of rotation of the controller, whereby a limited available space in equipment may be used to the full extent and more free layouts of various components may be permitted.

According to the present invention, the mechanical power transmission means which transmits the rotation of the controller to the controlled unit which is remotely positioned comprises in general a core and a plurality of layers of helical springs tightly wound in the opposite directions alternately, both ends of each helical spring being fixedly joined to the underlying helical spring without constraining the coils between the ends.

BRIEF DESCRIPTION OF THE DRAWINGS

Same reference numerals are used to designate similar parts throughout the figures.

DESCRIPTION OF THE PREFERRED EMBODIMENTS

Figure 1:
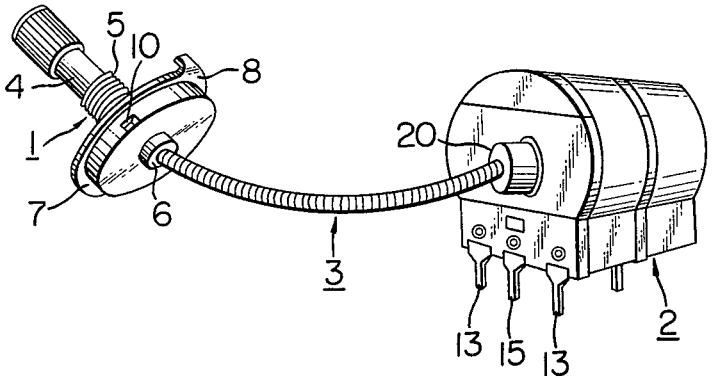
FIG. 1 is a perspective view of a first embodiment of a mechanical remote control system in accordance with the present invention.
Figure 2:
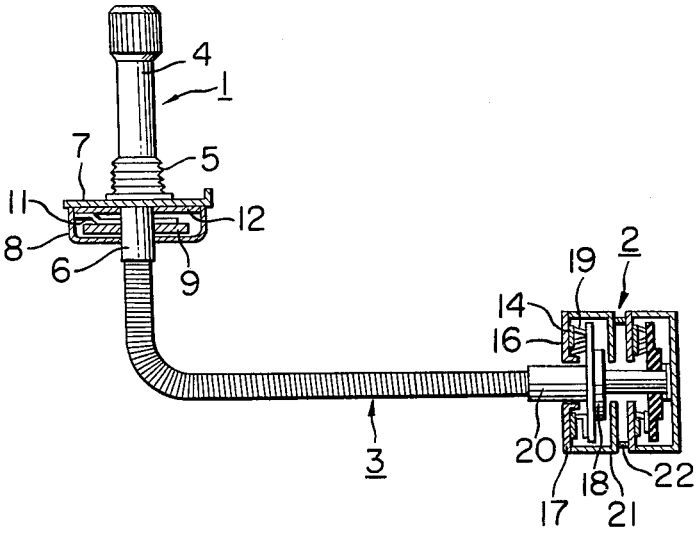
FIG. 2 is a longitudinal cross sectional view thereof.
Figure 3:
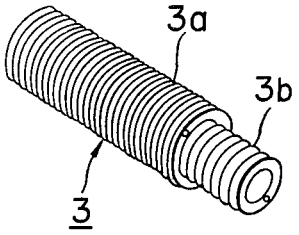
FIG. 3 is a fragmentary perspective view, on enlarged scale, of a mechanical power transmission means thereof.

First Embodiment, FIGS. 1 through 3

In FIGS. 1 and 2 is shown a first embodiment of a mechanical remote control system comprising a rotary controller or master 1, and a rotary electric or electronic control component which is a controlled unit or slave 2 and is located at a position remote from the master 1 and operatively coupled thereto through a mechanical power transmission means 3 adapted to transmit the rotating force produced by the master 1 to the slave 2.

As best shown in FIG. 3, the power transmission means 3 comprises a double-wound helical spring consisting of an outer tight wound helical spring 3*a* and an inner tight wound helical spring 3*b*. The outer and inner helical springs 3*a* and 3*b* are wound in the opposite directions and the outer helical spring 3*a* is slightly shorter in length than the inner helical spring 3*b* and has its both ends securely joined by for instance calking to the inner helical spring 3*b* adjacent to the ends thereof. However the coils of the outer helical spring 3*a* between the outermost coils are not restrained by the inner helical spring 3*b*. Since the double-wound helical spring with the above-described construction is used as the power transmission means 3 between the master 1 and the slave 2 so that the so-called "angular mismatching or alignment" may be completely avoided and consequently the precision controllability may be remarkably improved. More particularly, in the first embodiment, when the master 1 is rotated in the clockwise direction, the rotating force is transmitted through the outer helical spring 3*a* which is wound in the clockwise direction, but when the master 1 is rotated in the counter-clockwise direction, the rotating force is transmitted through the inner helical spring 3*b* which is wound in the counter-clockwise direction. As a result, the dissipation of the rotating force may be substantially suppressed during the transmission from the master 1 to the slave 2. As a consequence, the so-called "angular mismatching or misalignment" may be overcomed. The present invention can, therefore, accurately remote control an electric component such as a variable resistor, a varistor or the like which is required to change its electrical quantity continuously and linearly. So far such accurate mechanical remote control has been impossible by the prior art.

Referring back to FIGS. 1 and 2, the master 1 which imparts the rotating force to the slave 2 through the power transmission means 3 has an operating shaft 4 rotatably extended through a bushing 5 securely mounted on or formed integral with a mounting plate 7. A washer or retaining ring (not shown) is fitted over the shaft 4 so that the latter may be prevented from being pulled out of the bushing 5. The inner end which is extended inwardly beyond the mounting plate 7 terminates into a connection means 6. Alternatively, a connection means 6 may be fabricated separately from the shaft and securely joined thereto. A nonrotating disk 9 is securely fitted over the connection means 6 and is formed with a stop means (not shown) which engages with an inwardly struck out stop 10 of a casing 8 mounted on the inner surface of the mounting plate 7 so as to enclose the nonrotating disk 9, so that the rotation of the shaft 4 may be prevented at a predetermined angular position when the stops engage with each other. The master 1 further includes a click stop comprising a click spring 11 with one end securely attached to the nonrotating disk 9 and a click disk 12 which is mounted on the inner surface of the mounting plate 7 and which engages with the other end of the click spring 11.

In the first embodiment, the slave 2 is a conventional variable resistor with a connection means 20. That is, the variable resistor comprises a U-shaped casing 21 made of metal, an end plate 17, a resistor 14 in the form of a horse-shoe which is mounted on the end plate 17 in the casing 21 and whose both ends are electrically connected to terminals 13, a contact 16 mounted on the end plate 17 and electrically connected to a terminal 15, and at least one (two shown in FIG. 2) spring contact finger 19 which electrically bridges between the resistor 14 and the contact 16 and is mounted on a spring contact finger disk 18. The connection means 20 is formed integral with the shaft of the spring contact finger disk 18 and is securely connected to one end of the power transmission means 3 with the other end connected securely to the connection means 6 of the master 1. As shown in FIG. 2, two variable resistors which has a common spring contact finger disk shaft may be ganged with connection means 22.

Figure 4:
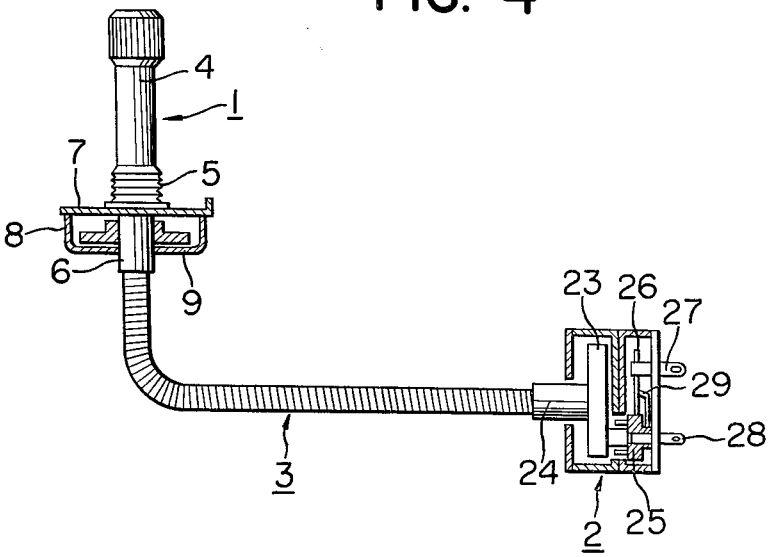
FIG. 4 is a longitudinal sectional view of a second embodiment of the present invention.

Second Embodiment, FIG. 4

In FIG. 4 is shown a second embodiment of the present invention which is substantially similar in arrangement to the first embodiment shown in FIGS. 1 and 2 except that the slave 2 is a rotary switch. The rotary switch may be of the conventional type comprising, in general, a casing, a rotary disk 23 with a shaft, a dot 25 driven by the rotation of the rotary disk 23, a movable contact 26 which is caused to swing by the dot 25, at least one stationary contact 27 and a bias spring 29 loaded between the dot 25 and the movable contact 26.

The connection means 24 may be formed with the shaft of the rotary disk 23 and is securely connected to one end of the power transmission means 3 with the other end securely connected to the connection means 6 of the master 6. Upon rotation of the shaft 4 of the master 1 in either direction, the rotating force is transmitted through the power transmission means 3 to the rotary disk 23 so that the latter is rotated in either direction to cause the movable contact 26 to make contact with or disconnect from the stationary contact 27.

Figure 5:
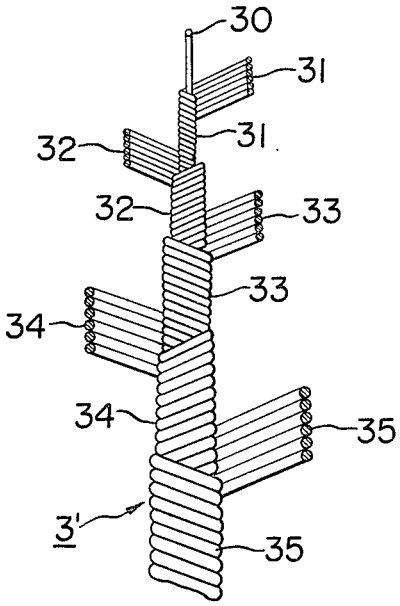
FIG. 5 is a view of a modification of the mechanical power transmission means shown in FIG. 3, the process for winding a plurality of helical springs being shown.

Modification of Power Transmission Means 3, FIG. 5

In FIG. 5 is shown a modification of the power transmission means 3 consisting of a core 30 which is not twisted at all, a first right lay 31 which consists of a plurality of flatly arrayed spring wires and is laid over the core directly, a first left lay 32 which consists of a plurality of flatly arrayed spring wires, a second right lay 33 which consists of a plurality of flatly arrayed spring wires and is helically wound around the first left lay 32, and a second left lay 34 which consists of a plurality of flatly arrayed spring wires and is helically wound around the second right lay 33. That is, in the power transmission means 3' the spring wire layers are helically wound in the opposite directions alternately. As with the first embodiment, both ends of each of the helically and tightly wound spring wire lays or layers 31 through 34 are securely joined to the underlying lay or layer by for instance caulking.

Since the spring wire lays or layers 31 through 34 are tightly wound without leaving any space between the lays or layers so that the expansion of each lay or layer may be prevented and consequently the rotating force may be more positively transmitted from the master to slave without causing any "angular mismatching or alignment" between them.

With the mechanical remote control system of the present invention, the electric components may be positioned at any desired positions on a printed-circuit board so that the degree of freedom in the design of component arrangements may be dramatically increased and additional interconnections between the electrical components may be avoided. Moreover the positions of the masters may be freely selected while the slaves must be needed to be located at predetermined positions on the printed circuit boards so that the more advanced standardization of printed circuit boards may become possible. Thus, even when the space for installation of electrical components is very limited, the higher degree of freedom in the designs of component arrangements may be permitted. Furthermore the problem of "angular mismatching or alignment" may be overcomed; that is, the control accuracy may be remarkably improved. Therefore even the variable resistors whose resistance must be varied continuously and linearly may be remote controlled very easily.

What is claimed is:

1. A mechanical remote control system comprising (a) a controller which is rotated in control operation, (b) a controlled electrical control means which is driven by the rotating force transmitted from said controller to change its electrical quantity or state in proportion to the annular rotation of said controller, and (c) a mechanical power transmission means interconnected between said controller and said controlled electrical control means for transmitting the rotating force from said controller to said controlled electrical control means, said power transmission means comprising a plurality of spring wire layers helically and tightly wound one upon another in the opposite directions alternately, both ends of each of said spring wire layers being securely joined to the underlying layer at the positions adjacent to the ends thereof, leaving the coils between the ends unconstrained.

2. A mechanical remote control system as set forth in claim 1 wherein said power transmission means comprises an inner helical spring tightly wound in one direction and an outer helical spring tightly wound around said inner helical spring in the opposite direction.

3. A mechanical remote control system as set forth in claim 1 wherein said power transmission means comprises a core and a plurality of spring wire layers wound one upon another helically, tightly and alternately in the opposite directions.

4. A mechanical remote control system as set forth in claim 1 wherein said controller comprises a rotary operating shaft, a bushing for rotatably receiving said rotary operating shaft, a retainer means interposed between said rotary operating shaft and said bushing for retaining said shaft in position, a stop means for limiting the rotation of said rotary operating shaft beyond a predetermined angular position, and a connection means formed integral with the inner end of said shaft or fabricated separately therefrom and securely joined thereto and securely connected to one end of said mechanical power transmission means.

5. A mechanical remote control system as set forth in claim 2 wherein said controller comprises a rotary operating shaft, a bushing for rotatably supporting said rotary operating shaft, a retainer means interposed between said rotary operating shaft and said bushing for retaining said shaft in position, a stop means for limiting the rotation of said rotary operating shaft beyond a predetermined angular position, and a connection means formed integral with the inner end of said shaft or fabricated separately therefrom and securely joined thereto and securely connected to one end of said mechanical power transmission means.

6. A mechanical power transmission system as set forth in claim 3 wherein said controller comprises a rotary operating shaft, a bushing for rotatably supporting said rotary operating shaft, a retainer means interposed between said rotary operating shaft and said bushing for retaining said shaft in position, a stop means for limiting the rotation of said rotary operating shaft beyond a predetermined angular position, and a connection means formed integral with the inner end of said shaft or fabricated separately therefrom and securely joined thereto and fixedly connected to one end of said mechanical power transmission means.

7. A mechanical remote control system as set forth in claim 1 wherein said controlled electrical control means consists of at least one variable resistor comprising a resistor whose ends are connected to terminals respectively, a contact, a spring contact finger mounted on a wiper mounting disk with a shaft for electrically bridging between said resistor and said contact, and a connection means formed integral with the shaft of said spring contact finger mounting plate and securely connected to one end of said power transmission means with the other end connected to said controller.

8. A mechanical remote control system as set forth in claim 2 wherein said controlled electrical control means consists of at least one variable resistor comprising a resistor whose ends are connected to terminals respectively, a contact, a spring contact finger mounted on a spring contact finger mounting disk with a shaft for electrically bridging between said resistor and said contact, and a connection means formed integral with said shaft of said spring contact finger mounting disk and securely connected to one end of said mechanical power transmission means with the other end connected to said controller.

9. A mechanical remote control system as set forth in claim 3 wherein said controlled electrical control means consists of at least one variable resistor comprising a resistor whose ends are connected to terminals respectively, a contact, a spring contact finger mounted on a wiper mounting disk with a shaft for electrically bridging between said resistor and said contact, and a connection means formed integral with said shaft of said spring contact finger mounting disk and securely connected to one end of said mechanical power transmission means with the other end connected to said controller.

10. A mechanical remote control system as set forth in claim 4 wherein said controlled electrical control means consists of at least one variable resistor comprising a resistor whose ends are connected to terminals respectively, a contact, a spring contact finger mounted on a wiper mounting disk with a shaft for electrically bridging between said resistor and said contact, and a connection means formed integral with said shaft of said spring contact finger mounting disk and securely connected to end of said mechanical power transmission means with the other end connected to said controller.

11. A mechanical remote control system as set forth in claim 1 wherein said controlled electrical control means is a switch comprising at least one stationary contact, a movable contact mounted on a rotary disk with a shaft so that upon rotation of said rotary disk said movable contact may make in contact with or disconnect from said stationary contact, and a connection means formed integral with said shaft of said rotary disk and securely connected to one end of said mechanical power transmission means with the other end connected to said controller.

12. A mechanical remote control system as set forth in claim 4 wherein said controlled electrical control means is a switch comprising at least one stationary contact, a movable contact mounted on a rotary disk with a shaft so that upon rotation of said rotary disk in either direction said movable contact may make into contact with or disconnect from said stationary contact, and a connection means formed integral with said shaft of said rotary disk and securely connected to one end of said mechanical power transmission means with the other thereof connected to said controller.

* * * * *